US006482298B1

(12) United States Patent
Bhatnagar

(10) Patent No.: US 6,482,298 B1
(45) Date of Patent: Nov. 19, 2002

(54) APPARATUS FOR ELECTROPLATING ALLOY FILMS

(75) Inventor: Parijat Bhatnagar, Salt Lake City, UT (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/671,223

(22) Filed: Sep. 27, 2000

(51) Int. Cl.[7] ..... C25D 14/00; C25B 9/00
(52) U.S. Cl. ..... 204/194; 204/242; 204/252
(58) Field of Search ..... 204/252, 253, 204/194; 205/353

(56) References Cited

U.S. PATENT DOCUMENTS

| | | | | | |
|---|---|---|---|---|---|
| 2,848,395 | A | * | 8/1958 | Carignan | 205/353 X |
| 4,443,305 | A | * | 4/1984 | Haynes | 205/353 |
| 5,403,460 | A | * | 4/1995 | Sala et al. | 204/252 |
| 5,882,502 | A | * | 3/1999 | Gomez | 205/568 |
| 6,251,255 | B1 | * | 6/2001 | Copping et al. | 205/300 |

OTHER PUBLICATIONS

Faust, C.L. "Principles of Alloy Plating" in: Lowenheim, F.A. *Modern Electroplating* (New York, John Wiley & Sons, 1974), pp. 486–505. (No Month).
Ross, C.A. *Electrodeposited Multilayer Thin Films*, Annu. Rev. Mater. Sci. vol. 24, 1994, pp. 159–169. No month.

* cited by examiner

*Primary Examiner*—Donald R. Valentine
(74) *Attorney, Agent, or Firm*—Fleit, Kain, Gibbons, Gutman & Bongini P.L.; Stephen Bongini; Casey P. August

(57) ABSTRACT

An electroplating bath includes two electrolytes that are separated by a low ionic mobility barrier substance. Electroplating substrates can be transferred between the two electrolytes, through the barrier substance. Successive layers can be deposited by alternately electroplating in the two electrolytes. The substrate need not be brought through an air-liquid interface in transferring it between the two electrolytes. More than one anode can be provided in each electrolyte for depositing alloy film layers. A dummy electrode can be provided in each electrolyte to be used in lieu of the substrate in order to change concentrations of compounds in each electrolyte so that sharp compositional transitions between successive layers deposited on the substrate can be obtained.

19 Claims, 3 Drawing Sheets

APPARATUS FOR ELECTROPLATING ALLOY FILMS

CROSS-REFERENCE TO RELATED APPLICATIONS

The present application is related to the inventor's applications entitled "METHOD AND APPARATUS FOR ELECTROPLATING ALLOY FILMS," Ser. No. 09/671,230, now U.S. Pat. No. 6,344,123, and "METHOD AND APPARATUS FOR ELECTROPLATING ALLOY FILMS," Ser. No. 09/671,976, now U.S. Pat. No. 6,344,124 which were filed on the same day as the present application. These related application are incorporated herein by reference.

FIELD OF THE INVENTION

The present invention pertains to a method and apparatus for depositing metal alloy films. More particularly the present invention pertains to a method and apparatus for electroplating alloy metal films.

BACKGROUND OF THE INVENTION

For a variety of technical applications it is desirable to be able to deposit multilayer films. For example, in semiconductor manufacturing applications a first layer of a multilayer film can be chosen based on its compatibility with the substrate (e.g., based on it's ability to adhere well to the substrate). A second layer, which provides further desired properties for the multilayer film such as high electrical conductivity or high corrosion resistance, is then deposited on the first layer.

A standard method for electroplating a multilayer film onto a substrate, is to use separate electroplating baths to deposit each layer of the multilayer film. During a transfer from one electroplating bath to another, an exposed surface of the multilayer film can become passivated by the formation of a native oxide of an exposed metal. The native oxide can hinder further electroplating, and can interfere with interfacial bonding between successive layers of the multilayer film. It may be possible to remove the native oxide, doing so requires additional chemical processing, which may also require the use of environmentally hazardous chemicals. Further, moving a substrate through an liquid/air interface is a major source of particulate contamination of substrates.

In response to such contamination problems, and the environmental problems of wet processing, the semiconductor industry migrated toward all "dry" processing during the 1980's. For example chemical vapor deposition (CVD), and sputtering are now typically used to deposit films in the semiconductor industry.

However, dry processing such as CVD or sputtering entails a high cost for purchasing and operating complex equipment which can include costly vacuum systems, and high frequency power supplies, and the use of hazardous gases.

Certain dry processing systems which avoid exposing substrates to the air have been proposed. However, these systems require costly evacuated or nitrogen purged containers and processing equipment fitted with specially designed ports for receiving the containers.

It would be desirable to be able to use the relatively inexpensive process of electroplating to deposit multilayer films.

Further, it would be desirable to be able use electroplating without incurring the problem of native oxide formation when transferring a substrate through the air between two electroplating baths.

Further, it would be desirable to be able to use electroplating for depositing multilayer films while reducing the potential for contamination of the substrate.

SUMMARY OF THE INVENTION

According to a preferred embodiment of the present invention an electroplating apparatus includes an electroplating bath container, a first electrolyte contained in the container, a second electrolyte contained in the container; and a barrier substance contained in the container.

A method for electroplating multilayer films is also provided.

BRIEF DESCRIPTION OF THE FIGURES

The subject matter which is regarded as the invention is particularly pointed out and distinctly claimed in the claims at the conclusion of the specification. The foregoing and other objects, features, and advantages of the invention will be apparent from the following detailed description taken in conjunction with the accompanying drawings.

DETAILED DESCRIPTION OF THE PREFERRED EMBODIMENTS

It should be understood that the embodiments presented are only examples of the many advantageous uses of the innovative teachings herein. In general, statements made in the specification of the present application do not necessarily limit any of the various claimed inventions. Moreover, some statements may apply to some inventive features but not to others. In general, unless otherwise indicated, singular elements may be in the plural and vice versa with no loss of generality.

Figure 1:
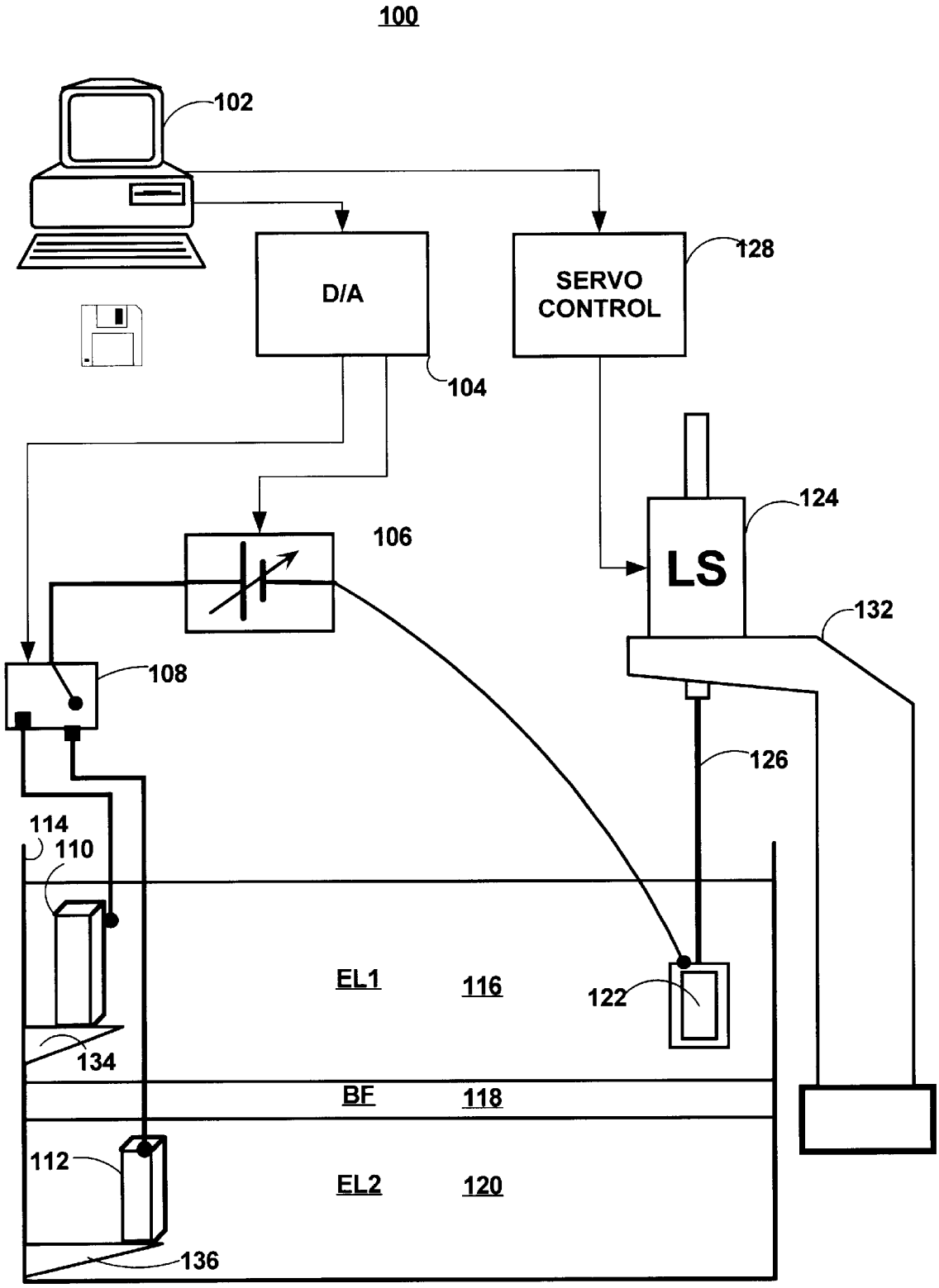
FIG. 1 is a schematic of an electroplating apparatus according to a first embodiment of the present invention.

FIG. 1 is a schematic of an electroplating apparatus 100 according to a first embodiment of the present invention. Referring to FIG. 1, the electroplating apparatus 100 comprises a control computer 102, which can for example comprise an IBM PC. The control computer 102 is electrically coupled to a digital-to-analog converter 104 (e.g., through an ISA card slot of the computer 102). The digital-to-analog converter 104 is electrically coupled to a control input of a variable power supply 106. The power supply 106 is for example a switch mode power supply, in which a control voltage read at the control input is used to determine a duty cycle of one or more power switches. The control computer 102 can vary a setting (e.g.,a voltage or current setting of the power supply 106) by controlling a voltage output by the analog to digital converter 104.

An anode terminal of the power supply 106 is electrically coupled to an input terminal of a single pole, double throw relay 108. A first output terminal of the single pole, double throw relay 108 is electrically coupled to a first source metal anode 110. A second output terminal of the single pole relay is electrically coupled to a second source metal anode 112. A control terminal of the single pole, double throw relay 108 is electrically coupled to the digital-to-analog converter 104, so that the control computer 102 can control the relay 108.

A cathode terminal of the power supply 106 is electrically coupled to an electroplating substrate 122 (working electrode). Rather than using one power supply 106, and the single pole, double throw relay 108, two separate power supplies are used in further embodiments. Further, one or more impedance networks can be interposed between the power supply 106 and the single pole, double throw relay 108 and/or between the relay 108 and either or both of the anodes 110 and 112.

An electroplating bath container 114 is provided. The container 114 holds a first electrolyte 116, a barrier substance 118, and a second electrolyte 120. As shown, in FIG. 1, the first electrolyte 116, second electrolyte 120, and barrier substance 118 have planar upper and lower boundaries. The barrier substance 118 forms a barrier film, with a planar geometric form. As shown in FIG. 1 the barrier substance 118 is located between the first electrolyte 116, and the second electrolyte 120, specifically above and contacting the second electrolyte 120, and below and contacting the first electrolyte 116.

The first and second electrolytes 116 and 120 can be selected from a group including but not limited to aqueous, organic liquid, gel, or polymer based electrolytes.

Preferably, the electrolytes 116, 120 comprise a gel or polymer electrolyte, and more preferably, the electrolytes 116, 120 comprise a semisolid gel.

The barrier substance can be selected from a group including but not limited to organic liquids, gels, or polymers. Preferably the barrier substance is a semi solid, more preferably a semisolid gel. Preferably the barrier substance 122 will have a lower ionic mobility with respect to ions present in the first and second electrolytes 116, 120, than the ionic mobilities of those ions in their respective electrolytes 116, 120. If the barrier substance has a lower ionic mobility, ion fluxes crossing from the first electrolyte 116, to the second electrolyte 120 and vice versa will be reduced. Therefore, electroplating occurs in each electrolyte 116,120 without interference or contamination by ions from the other electrolyte.

The first electrolyte 116 is preferably chosen to have a first specific gravity which is lower than a second specific gravity which characterizes the second electrolyte 120. In the embodiment shown in FIG. 1, the barrier substance 118 is preferably chosen to have a specific gravity which is intermediate between the first specific gravity of the first electrolyte 116 and the second specific gravity of the second electrolyte 120. The foregoing selection of specific gravities, tends to make the arrangement of the barrier film 118 and first and second electrolytes 116,118 stable.

The first anode 110 is supported in the first electrolyte 116 by a first anode support 134. The second anode 112 is supported in the second electrolyte 118 by a second anode support 136. As shown, supports 134, 136 take the form of shelves on which the respective anodes 110 rest. In further embodiments, other types of anode supports are used. For example some embodiments use hanging anode supports.

The substrate 122 is supported by a, preferably electrically insulating, tether 126 which is mechanically coupled to a servo 124. The servo 124 is supported by a support 132. The servo 124 is electrically coupled to a servo controller 128. The servo controller is electrically coupled to the control computer 102. The control computer 102 operates the servo 124 through the servo controller 128 in order to move electroplating substrate 122 through the barrier substance from the first electrolyte 116, to the second electrolyte 120, and back.

Each electrolyte 116, 120 has a composition suitable for electroplating a particular electroplate film, e.g., it has a particular set of concentrations of electroplating solutes (such as salt compounds including a metal to be deposited). Power supply settings (e.g., voltage, and/or current), supplied by power supply 106 can also be optimized for each electrolyte. Selection of electrolyte solutions, and power supply settings for electroplating are known to one of ordinary skill in the electroplating art.

In operation, during a first period, the relay 110 is switched to supply power to the first anode 110, the power supply 106 is adjusted to a first predetermined setting, the electroplating substrate 122 is positioned in the first electrolyte 116, and electroplating on to the substrate 122 is conducted in the first electrolyte 116.

The first predetermined setting corresponds to a voltage applied between the anode 110 and the substrate 122. If the power supply 106 is a current regulating type (as opposed to a voltage regulating type), the value of the aforementioned voltage may depend on the identity of the first anode 110 metal, the first electrolyte 116 composition, and an area of contact between the first anode 110 and the electrolyte.

After the first period, the substrate 122 is moved from the first electrolyte 116, though the barrier substance 118, to the second electrolyte Additionally, the relay is switched to supply power to the second anode 112, and the power supply is adjusted to a second predetermined setting. During a second period electroplating on to the substrate 122 is conducted in the second electrolyte 120.

A computer readable medium 130 can be used for loading a control program onto the control computer 102 for controlling the electroplating apparatus for carrying out the electroplating process described above. A predetermined schedule which dictates the times at which the relay 106 is switched, and at the times at which the substrate 122 is moved, and power settings to be applied to the power supply 106 can also be loaded onto the control computer 102. In one form of the schedule is represented as follows:

| START TIME | END TIME | POWER SUPPLY SETTING. | RELAY SUPPLIES POWER TO: | SUBSTRATE LOCATION |
|---|---|---|---|---|
| T1 | T2 | V1 | $1^{ST}$ ANODE | $1^{ST}$ ELECTROLYTE |
| T2 | T3 | SUBSTRATE BEING MOVED FROM $1^{ST}$ TO $2^{ND}$ ELECTROLYTE | | |
| T3 | T4 | V2 | $2^{ND}$ ANODE | $2^{ND}$ ELECTROLYTE |
| T4 | T5 | SUBSTRATE BEING MOVED FROM $2^{ND}$ TO $1^{ST}$ ELECTROLYTE | | |
| T5 | T6 | V1 | $1^{ST}$ ANODE | $1^{ST}$ ELECTROLYTE |

The above electroplating process provides electroplated films with sharp interfaces between successive layers. The process is advantageously accomplished without transferring the substrate 122 through a liquid-air interface. The power supply settings can be voltage settings or current settings.

In further embodiments, the barrier substance 118 is not provided. In such embodiments, the first electrolyte 116 and the second electrolyte 118 should be immiscible. Furthermore, in such embodiments, the solubility of a first salt including a metal from the, first anode 110 is preferably higher in the first electrolyte 116 than in the second electrolyte 120. Likewise, the solubility of a second salt including a metal from the second anode 112 is preferably higher in the second electrolyte 120 than in the first electrolyte 116.

Figure 2:
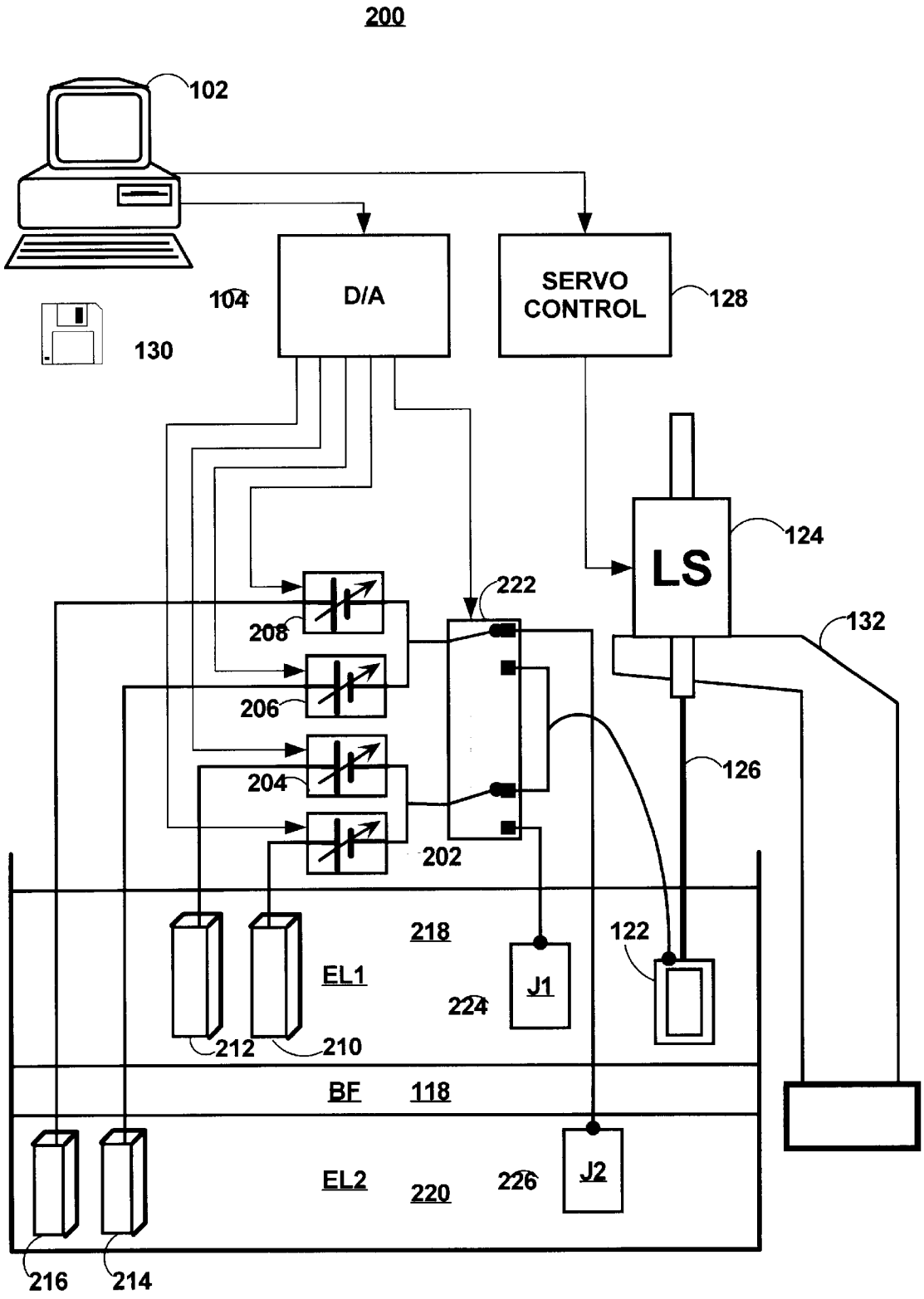
FIG. 2 is a schematic of an electroplating apparatus according to a second embodiment of the present invention.

FIG. 2 is a schematic of a second electroplating apparatus 200 according to a second embodiment of the present invention. Many of the elements shown in FIG. 2 are the same as elements shown in FIG. 1. In FIG. 2 they are labeled with the FIG. 1 reference numerals.

The second electroplating apparatus 200 comprises a first variable power supply 202 including a first anode terminal electrically coupled to a first anode 210; a second variable power supply 204 including a second anode terminal electrically coupled to a second anode 212; a third variable power supply 206 including a third anode terminal electrically coupled to the third anode 214; and a fourth variable power supply 208 including a fourth anode terminal electrically coupled to a fourth anode 216. The first and second anodes 210, 212 are in contact with a first electrolyte 218. The first electrolyte comprises a first dissolved disassociated compound (e.g., a salt) which includes a metal from the first anode 210, and a second dissolved disassociated compound which includes a metal from the second anode 212. The third and fourth anodes 214,216 are in contact with a second electrolyte 220. The second electrolyte comprises a third dissolved disassociated compound which includes a metal from the third anode 214, and a fourth dissolved disassociated compound which includes a metal from the fourth anode 216.

Although depicted in FIG. 2 as ideal voltage sources, the power supplies 202, 204, 206, and 208 can comprise current sources or other non ideal power supplies.

The first and second anodes 210, 212 are supported in the first electrolyte 218 by supports (not shown) such as the first anode support 134 (FIG. 1). The third and fourth anodes 214,216 are also supported in the second electrolyte 220 by supports (not shown). The first and second variable power supplies 202, 204 respectively have first and second cathode terminals that are both coupled to a first input of a double pole, double throw relay 222. The third and fourth variable power supplies 206, 208 respectively have third and fourth cathode terminals that are both coupled to a second input of a double pole, double throw relay 222. A first output of the double pole, double throw relay 222 is electrically coupled to a first dummy electrode 224 that is in contact with the first electrolyte 218. A second and a third output of the double pole, double throw relay 222 are electrically coupled to the electroplating substrate 122. A fourth output of the double pole, double throw relay 222 is electrically coupled to a second dummy electrode 226 that is in contact with the second electrolyte 220.

According to an alternative embodiment a single dummy electrode is moved by a servo between the first electrolyte 116, and the second electrolyte 120.

The digital-to-analog converter 104 is electrically coupled to control inputs of the four variable power supplies 202, 204, 206, and 208, to allow the four power supplies 202,204, 206, 208 to be controlled by the control computer 102. The digital-to-analog converter 104 is also electrically coupled to the control input of the double pole, double throw relay 222 so that it can be controlled by the control computer 102 as well. An amplifier such as a Darlington transistor pair (not shown) can be inserted between the digital-to-analog converter 104 and the double pole, double throw relay 222, if necessary to supply sufficient current to operate the relay 222.

The relative percentages of a metal from the first anode 210 and a metal from the second anode 212 deposited on the first dummy electrode 224 or the substrate 122 (when it is in the first electrolyte 218), depend on relative concentrations of the first and second dissolved disassociated compounds in the first electrolyte 218. (Analogous considerations apply to electroplating in the second electrolyte.) The relative concentrations of the first and second dissolved disassociated compounds can be controlled by controlling the settings of the first and second power supplies 202, 204. By routine experimentation, concentrations of the first and second compounds which result in a desired alloy composition can be determined. Generally, a higher compound concentration in the solution will result in a higher percentage of a metal from the compound in a deposited film. However, the relation is not linear, therefore some experimentation with different relative concentrations is generally necessary. Once the concentrations are determined, settings of the first and second power supplies 202, 204, which result in the determined concentrations being maintained, as electroplating is carried out, are determined, again, by routine experimentation.

The power supply settings correspond to voltages applied between the respective anode 210, 212, 214, 216 coupled to each power supply 202,204,206, 208 and either the electroplating substrate 122 or a corresponding one of the dummy electrodes 224, 226.

If the power supply settings are current settings (in a current regulating power supply), then the ratio of settings of the two power supplies coupled to two anodes in contact with the same electrolyte should be approximately proportional to the ratio of the gram equivalent weights of metal from the respective anodes which are present in the alloy which it is desired to electroplate on the substrate in that electrolyte. However, the relation may not be exact due, at least in part, to the existence of current which does not result in plating (e.g.,current that results in hydrogen evolution). Therefor some routine experimentation with different currents settings may be necessary to determine the settings that are required to obtain a preselected alloy composition.

If the power supply setting corresponds to a voltage (in a voltage regulating power supply), the dependance of the deposited alloy composition on the power settings is more complicated (the dependance of current on voltage is approximately exponential in character). There is a one-to-one relationship between a correct voltage setting, and a correct current setting, so a correct voltage setting to be used with voltage regulating power supplies can be measured after optimizing a process using a current regulating power supply. Alternatively voltage settings can be determined directly by routine experimentation.

If the power settings of the first and second powers supplies 202, 204 are changed continuously or even abruptly, the composition of an electroplate film being deposited on the substrate 122 positioned in the first electrolyte 218 will change continuously, not abruptly. This is due to the fact that concentrations of the first and second compounds in the first electrolyte 218 will adjust gradually to the change in the power settings.

In order to obtain a sharp transition in the composition of an electroplated film, as a function of depth in the film, a dummy electrode 224, 226 is preferably employed. A method and apparatus for obtaining a sharp alloy composition transition in electroplating in a single electrolyte solution is disclosed in the inventors co-pending application entitled "METHOD AND APPARATUS FOR ELECTROPLATING ALLOY FILMS". The method will now be explained briefly with reference to a process carried out in the first electrolyte 218. During a first period, electroplating onto the substrate 122 is performed with a first set of settings (voltages) of the power supplies 202, 204, and a first alloy with a first composition is obtained. A second set of settings is then applied to the power supplies 202, 204, and the power supplies are disconnected from the substrate 122, and connected to the dummy electrode 224. Electroplating onto the dummy electrode 224 is then carried out during a second period. Thus during the second period, concentrations of the first and second compounds in the electrolyte gradually change from a first set of values consistent with the first set of settings to a second set of values consistent with the second set of settings. During the second period, relative percentages of metals present in an alloy deposited onto the dummy electrode 224 gradually change from the first composition to a second composition. The dummy electrode 224 is then disconnected from the power supplies 202, 204, and the substrate 122 is reconnected to the power supplies 202, 204. Electroplating onto the substrate is then recommenced for a third period during which an alloy having the second composition is deposited onto the substrate 122. The foregoing method produces a electroplated film on the substrate 122 which is characterized by a sharp transition from the first alloy composition to the second alloy composition.

The second electroplating apparatus 200 can be used to produce an electroplated film comprising four different alloy layers. For example, the first and third alloy layers can include metals from the first and second anodes 210, 212 yet have different alloy compositions (different percentages of the two metals). Analogously, second and fourth alloy layers can include metals from the third and fourth anodes 214, 216 which are present in different percentages. A method of operation of the second electroplating apparatus 200 to produce this type of electroplated film will presently be described.

Initially, the first electrolyte is prepared with concentrations of the first and second compounds that are suitable for depositing a first alloy, and the second alloy is prepared with concentrations of the third and fourth compounds that are suitable for depositing a second alloy. During a first period, the substrate is positioned in the first electrolyte 220. The double pole, double throw relay is placed in the position shown in FIG. 2 (i.e., the first input is electrically coupled to the second output so that cathode terminals of the first and second power supplies 202, 204 are coupled to the substrate 122; and the second input is electrically coupled to the fourth output so that cathode terminals of the third and fourth power supplies 206, 208 are electrically coupled to the second dummy electrode 226).

During the first electroplating period the settings of the first and second power supplies 202, 204 are adjusted to values (i.e.,voltages) chosen so as to maintain the concentrations of the first and second compounds, and to deposit the first alloy layer onto the substrate 122. During the first period, the third and fourth power supplies 206, 208 can be turned off.

The length of the first period is related to the thickness of the first alloy layer. According to a preferred embodiment, the length of the first period is selected to obtain a predetermined thickness.

After the first period the substrate 122 is moved from the first electrolyte 116, through the barrier substance 118, into the second electrolyte 120. During a second period the substrate 122 is positioned in the second electrolyte 220.

During the second period the double pole, double throw relay 222 is set to a second position in which the first input is electrically coupled to the first output so that cathode terminals of the first and second power supplies 202, 204 are electrically coupled to the first dummy electrode 224; and the second input is electrically coupled to the fourth output so that cathode terminals of the third and fourth power supplies 206, 208 are electrically coupled to the substrate 122.

At the commencement of the second period the settings of the first and second power supplies 202, 204 are changed to values (voltages) that are used to deposit the third alloy. During the third period, concentrations of the first and second compound will change from the values used to deposit the first alloy to values to be used to deposit a third alloy.

At the commencement of the second period, settings of the third and fourth power supplies are adjusted to values which maintain the concentrations of the third and fourth compounds, and deposit the second alloy layer on the substrate 122.

The length of the second period is chosen to be the greater of the time required to deposit a preselected thickness of the second alloy layer and the time required to change the concentrations of the first and second compounds to values used to deposit the third alloy layer. If the latter time exceeds the former, then the third and forth power supplies 208, 210 can be turned off after the second alloy layer is deposited. If the former time exceeds the latter, then the first and second power supplies 210, 212 can be turned off once the concentrations of the first and second compounds reach values used to deposit the third alloy layer, in order to conserve the first and second anodes 210, 212.

During a third period, the substrate 122 is once again positioned in the first electrolyte. The double pole, double throw relay 222 is switched back to the position used during the first period. The settings of the first and second power supplies 202, 204 set at the beginning of the second period are maintained during the third period. The settings of the third and fourth power supplies 206, 208 are change to values used to deposit the fourth alloy. A third alloy layer is deposited onto the substrate 122 in the first electrolyte 218. In the second electrolyte, 220 the concentrations of the third and fourth compounds are changed from the values used to deposit the second alloy to values to be used to deposit a fourth alloy.

Selection of the length of the third period can be based on considerations analogous to those discussed above in connection with the second period.

During a fourth period, the substrate 122 is again positioned in the second electrolyte. The double pole, double throw relay is switched to the position used during the second period. During the fourth period, the fourth alloy layer is deposited onto the substrate 122.

The second electroplating apparatus 200 has the advantage that it is able to deposit the above described four layer film, while obtaining sharp transitions in composition at the interfaces between the four layers. Furthermore, this can be done without discontinuing electroplating onto the substrate 122 for a protracted period of time during which concentrations of compounds in an electrolyte are changed.

Although two electrolytes 218, 220, and one barrier substance 118 are shown in FIGS. 1 and 2, a greater number of electrolytes, and/or a greater number of barrier films can be provided for electroplating more complex films. Additionally, although two anodes per electrolyte are shown in FIG. 2, a greater number of anodes per electrolyte can be provided for inter alia deposited alloy films comprising more than two metals.

Figure 3:
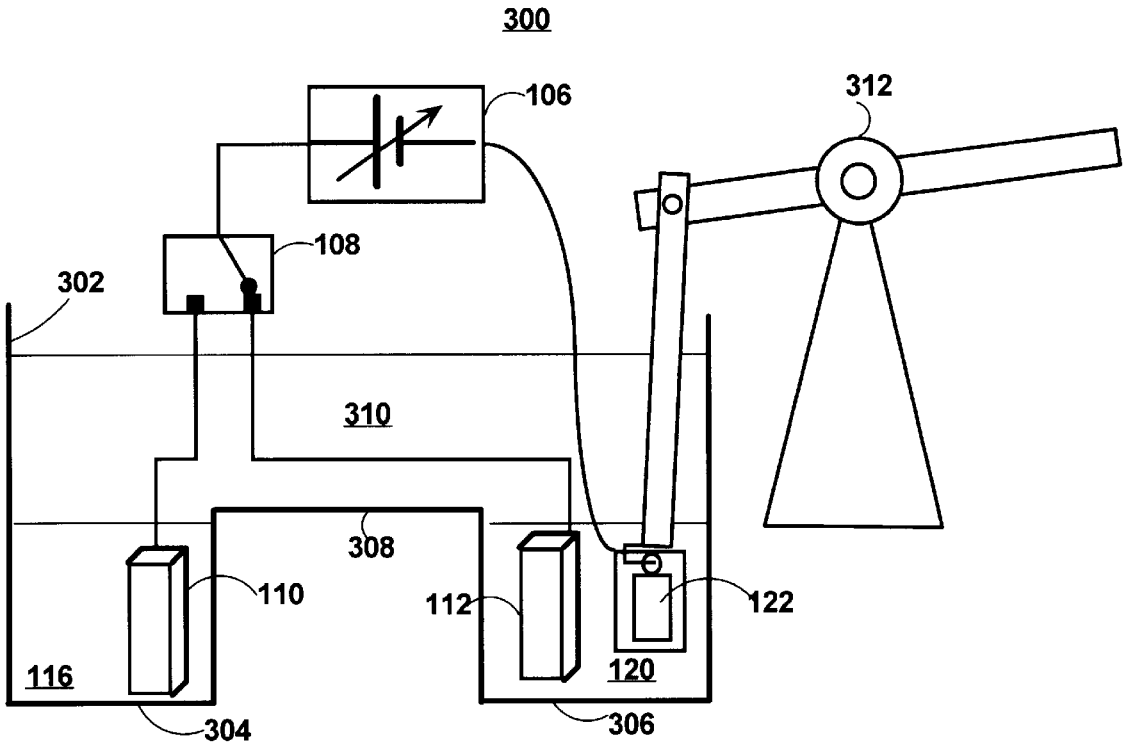
FIG. 3 is a schematic of a part of an electroplating apparatus according to a third embodiment of the present invention.

FIG. 3 is a schematic of part of a third electroplating apparatus 300 according to a third embodiment of the present invention. The third electroplating apparatus is distinguished from the apparatus of FIG. 1 by the arrangement of the electrolytes and barrier substance.

Referring to FIG. 3, a second electroplating bath container 302 comprises a first cylindrical well 304 and a second cylindrical well 306 extending from a bottom surface. 308. The first electrolyte 116 is contained in the first cylindrical well 304, and the second electrolyte 120 is contained in the second cylindrical well 306.

A barrier substance 310 is contained in the second electroplating bath container 302 above the first and second electrolytes 116, 118. The barrier substance 302 is immiscible with the first and second electrolytes 116, 118. The barrier substance preferably has a lower ionic mobility with respect to ions included in the first and second electrolytes 116, 118 than the first and second electrolytes 116, 118. The barrier substance preferably has a lower specific gravity than the first and second electrolytes 116, 118. The barrier substance can be selected from a group including but not limited to organic liquids, gels, or polymers.

A robotic manipulator 312 or other mechanism is provided for transporting the substrate through the barrier substance 310 between the first electrolyte 116 and the second electrolyte 118. The robotic manipulator includes an end effector (e.g., gripper) for grasping the substrate 122.

Although two cylindrical wells have been described in connection with FIG. 3, a larger number of cylindrical wells could be provided. The wells need not be necessarily cylindrical in shape. Also, more than one, anode could be used in each well for maintaining concentrations of solutes in each electrolyte at values suitable for electroplating predetermined alloy films according to the teachings of the inventors copending applications referenced above.

Using the third electroplating apparatus 300, multiple film layers can be deposited on the substrate 122 without moving it across an air-liquid interface. In as much as the substrate 122 does not need to be moved across an air-liquid interface in the course of electroplating multiple film layers, contamination of the substrate with particles collected at the air-liquid interface is avoided. Furthermore, formation of interfacial native oxides between successive layers, which develop when transferring substrates between separate plating baths is avoided.

Although the invention has been described with reference to three specific embodiments shown in the FIGS. various modifications, which are within the scope of the appended claims will be apparent to persons having ordinary skill in the art to which the invention pertains.

What is claimed is:

1. An electroplating apparatus comprising:

an electroplating bath container, a first electrolyte contained in the container;

a second electrolyte contained in the container;

a first anode contained in the container so as to be in contact with the first electrolyte;

a first dummy electrode contained in the container so as to be in contact with the first electrolyte; and a barrier substance contained in the container so as to be in contact with the first and second electrolytes contained in the container, the barrier substance being non-solid so as to allow movement of an electroplating substrate through the barrier substance.

2. The electroplating apparatus according to claim 1 wherein: the barrier substance is immiscible with both the first and second electrolytes.

3. The electroplating apparatus according to claim 1 wherein:

the first electrolyte has a planar lower boundary;

the barrier substance has a planar upper boundary and a planar lower boundary;

the second electrolyte has a planar upper boundary; and the barrier substance is located between the first and second electrolytes, the barrier substance forming a barrier film with a planar geometric form.

4. The electroplating apparatus according to claim 1 wherein:

the barrier substance has an ionic mobility that is less than the ionic mobility of the first electrolyte for ions contained in the first electrolyte and less than the ionic mobility of the second electrolyte for ions contained in the second electrolyte.

5. An electroplating apparatus comprising:

an electroplating bath container;

a first electrolyte contained in the container;

a second electrolyte contained in the container, a first anode contained in the container so as to be in contact with the first electrolyte;

a first dummy electrode contained in the container so as to be in contact with the first electrolyte; and a barrier substance contained in the container so as to be in contact with the first and second electrolytes contained in the container, wherein the first electrolyte is located above the barrier substance; and the second electrolyte is located below the barrier substance.

6. The electroplating apparatus according to claim 5 wherein:

the first electrolyte has a first specific gravity;

the second electrolyte has a second specific gravity, which is greater than the first specific gravity; and the barrier substance has a third specific gravity, which is between the first specific gravity and the second specific gravity.

7. The electroplating apparatus according to claim 5 wherein:

the barrier substance has an ionic mobility that is less than the ionic mobility of the first electrolyte for ions contained in the first electrolyte and less than the ionic mobility of the second electrolyte for ions contained in the second electrolyte.

8. An electroplating apparatus comprising:

an electroplating bath container;

a first electrolyte contained in the container;

a second electrolyte contained in the container; and a barrier substance contained in the container so as to be in contact with the first and second electrolytes contained in the container, wherein the barrier substance is located above both the first electrolyte and the second electrolytes.

9. The electroplating apparatus according to claim 5 further comprising:

a servo for moving an electroplating substrate through the barrier substance from the first electrolyte to the second electrolyte.

10. The electroplating apparatus according to claim 8 wherein:

the first electrolyte has a first specific gravity;

the second electrolyte has a second specific gravity; and the barrier substance has a third specific gravity, which is less than the first specific gravity and less than the second specific gravity.

11. The electroplating apparatus according to claim 8 wherein:

the barrier substance has an ionic mobility that is less than the ionic mobility of the first electrolyte for ions contained in the first electrolyte and less than the ionic mobility of the second electrolyte for ions contained in the second electrolyte.

12. The electroplating apparatus according to claim 8 wherein:

the container includes at least a first well and a second well;

the first electrolyte is contained in the first well; and the second electrolyte is contained in the second well.

13. An electroplating apparatus comprising:

an electroplating bath container;

a first electrolyte contained in the container;

a second electrolyte contained in the container;

a barrier substance contained in the container so as to be in contact with the first and second electrolytes contained in the container; and a servo for moving an electroplating substrate through the barrier substance from the first electrolyte to the second electrolyte.

14. An electroplating apparatus comprising:

an electroplating bath container, a first electrolyte contained in the container;

a second electrolyte contained in the container;

a barrier substance contained in the container so as to be in contact with the first and second electrolytes contained in the container;

a first anode contained in the container so as to be in contact with the first electrolyte;

a second anode contained in the container so as to be in contact with the first electrolyte; and a first dummy electrode contained in the container so as to be in contact with the first electrolyte.

15. The electroplating apparatus according to claim 14 further comprising:

a first power supply coupled to the first anode; and a second power supply coupled to the second anode.

16. The electroplating apparatus according to claim 15 further comprising:

a third anode contained in the container so as to be in contact with the second electrolyte; and a fourth anode contained in the container so as to be in contact with the second electrolyte.

17. The electroplating apparatus according to claim 16 further comprising:

a second dummy electrode contained in the container so as to be in contact with the second electrolyte.

18. An electroplating apparatus comprising:

an electroplating bath container;

a first electrolyte contained in the container;

a second electrolyte contained in the container;

a barrier substance contained in the container so as to be in contact with the first and second electrolytes contained in the container;

a first anode contained in the container so as to be in contact with the first electrolyte;

a second anode contained in the container so as to be in contact with the first electrolyte; and a servo for moving an electroplating substrate through the barrier substance from the first electrolyte to the second electrolyte.

19. An electroplating apparatus comprising:

an electroplating bath container adapted to contain a first electrolyte and a second electrolyte;

a first anode contained in a portion of the container that is adapted to contain the first electrolyte;

a first dummy electrode contained in a portion of the container that is adapted to contain the first electrolyte; and a barrier substance contained in the container and adapted to be in contact with the first and second electrolytes, the barrier substance being non-solid so as to allow movement of an electroplating substrate through the barrier substance.

* * * * *